US005900043A

United States Patent [19]

Grandjean et al.

[11] Patent Number: 5,900,043

[45] Date of Patent: May 4, 1999

[54] ELECTROSTATIC FILTER WITH PROCESS FOR FAST CLEANING WITHOUT BREAKING CONFINEMENT

[75] Inventors: Jean-Paul Grandjean, Sabran; Jean-Raymond Bernard, Courcelles de Touraine; Guy Pilot, Magny les Hareaux, all of France

[73] Assignee: Commissariat a l'Energie Atomique, Paris, France

[21] Appl. No.: 08/841,065

[22] Filed: Apr. 29, 1997

[30] Foreign Application Priority Data

Apr. 30, 1996 [FR] France ..... 96 05417

[51] Int. Cl.[6] ..... B03C 3/76

[52] U.S. Cl. ..... 95/29; 55/288; 55/292; 55/312; 95/76; 95/282; 96/32; 96/405

[58] Field of Search ..... 95/11, 76, 29, 95/278, 282; 96/32, 399, 405; 55/292, 312, 288, 212, 215, 283, 314

[56] References Cited

U.S. PATENT DOCUMENTS

| | | | |
|---|---|---|---|
| 3,053,031 | 9/1962 | Vedder et al. | 55/92 |
| 3,366,234 | 1/1968 | Suhm et al. | 55/292 X |
| 3,685,257 | 8/1972 | Burke | 55/292 X |
| 5,062,965 | 11/1991 | Bernou et al. | 55/292 X |
| 5,212,948 | 5/1993 | Gillingham et al. | 55/314 X |
| 5,305,602 | 4/1994 | Kojima et al. | 55/283 X |
| 5,489,319 | 2/1996 | Tokuda et al. | 55/283 X |
| 5,540,755 | 7/1996 | Spokoyny et al. | 55/292 X |

FOREIGN PATENT DOCUMENTS

| | | | |
|---|---|---|---|
| 609987 | 8/1926 | France . | |
| 2638659 | 5/1990 | France . | |
| 315534 | 10/1917 | Germany . | |
| 2701498 | 3/1978 | Germany . | |
| 955989 | 9/1982 | U.S.S.R. | 55/292 |
| 1002010 | 3/1983 | U.S.S.R. . | |

*Primary Examiner*—Richard L. Chiesa
*Attorney, Agent, or Firm*—Pearne, Gordon, McCoy & Granger LLP

[57] ABSTRACT

Electrostatic filter in which the enclosure (2) is fitted with a flexible membrane (12) , behind which an acoustic wave generator (14) is placed and which vibrates the gaseous contents of the filter to detach retained dust and clean the filter.

8 Claims, 3 Drawing Sheets

ELECTROSTATIC FILTER WITH PROCESS FOR FAST CLEANING WITHOUT BREAKING CONFINEMENT

BACKGROUND OF THE INVENTION

This invention relates to an electrosatic filter with a process for fast cleaning without breaking confinement.

Electrostatic filters are composed of electricity conducting elements brought to different voltages by means of a DC voltage generator. Powerful electrostatic charges are created between these elements, between which a gas current passes carrying dust: particles making up this dust, ionized naturally or after a prior operation, are attracted by the conducting elements and deposited on them. Electrostatic filters have proved to be very useful for purifying gases containing large quantities of impurities such as combustion gases; they are frequently used on the inlet side of very high efficiency filters which retain the finest particles but which would become dirty too quickly if the gases reached them directly.

However, it is inevitable that electrostatic filters also become dirty, despite the relatively large gaps between conducting elements, so that cleaning processes are provided.

Brushes or scrapers are usually used that are applied along the length of the conducting elements, but this significantly complicates the filter. One possibility that was considered was to separate accumulated impurities by vibrations, by shaking or applying shocks on the sides of conducting elements, but this requires a large amount of energy and it is not always easy to determine the optimum conditions for vibrations to clean efficiently, and in any case mechanical vibrations could damage the filter.

Ultrasonic transducers are used in patent FR-A-2,638,659, through openings in the filter enclosure. These transducers are terminated by a rigid metal ground acting as an ultrasound emitter. This design can only be satisfactory in an aqueous environment, and therefore is not suitable for removing dust from gas.

Note also the author's certificate SU-A-927,317, in which cleaning is done by brushes and a reversal of the electrostatic field and in which detached particles are guided by sirens, the acoustic waves from which are propagated in the filter without contributing directly to cleaning. The sirens are engaged in the filter without being separated from filter elements by any membrane or partition, which compromises the confinement. Finally, the sirens must operate continuously during cleaning, and the resulting noise level is very annoying.

BRIEF SUMMARY OF THE INVENTION

A new process is provided with the invention, consisting of vibrating the gaseous volume contained in the filter enclosure rather than the solid elements of the filter itself, by means of a sound wave generator placed behind a flexible membrane that forms part of the filter enclosure and isolates the generator from the contents of the enclosure, while efficiently transmitting the sound waves produced. Therefore, the confinement provided by the filter enclosure is not broken during cleaning.

The sound wave generator is adjusted to produce acoustic vibrations at a frequency almost coincident with the membrane frequency in order to produce the required vibrations in the filter, but no limit is fixed, such that the invention can cover ultrasound or infrasound frequencies if necessary; in practice, it has been found that a low frequency generator gives good results. Thus for example, pulses of a tenth of a second or a few tenths of a second, at a rate of 1 every 2 seconds, can produce complete cleaning after about 10 seconds.

One result of this fast cleaning is that the filter operation only needs to be interrupted (if at all) for a small proportion of its time in service, unlike processes in which brushes and scrapers are used which require a fairly long interruption which is frequently impossible to avoid since in some cases scrapers obstruct the filter completely. The benefit obtained is particularly significant when circulation of gases containing dust must be continuous, for example when it is produced by continuous combustion: in existing installations in which the filtration has to be stopped for cleaning, a second electrostatic filter has to be placed in parallel with the first, and the gas current has to be passed through the second filter while the first filter is being cleaned. This second filter becomes useless with the invention, since if the interruption is short enough, the gases containing dust can simply be redirected towards the high efficiency filter placed on the outlet side of the electrostatic filter, bypassing the electrostatic filter; the additional dust accumulation in the high efficiency filter remains very moderate.

BRIEF DESCRIPTION OF THE SEVERAL VIEWS OF THE DRAWING

We will now describe the invention in more detail with reference to the Figures attached in the appendix for illustration purposes, and in no way restrictive.

DESCRIPTION OF THE INVENTION

Figure 1:
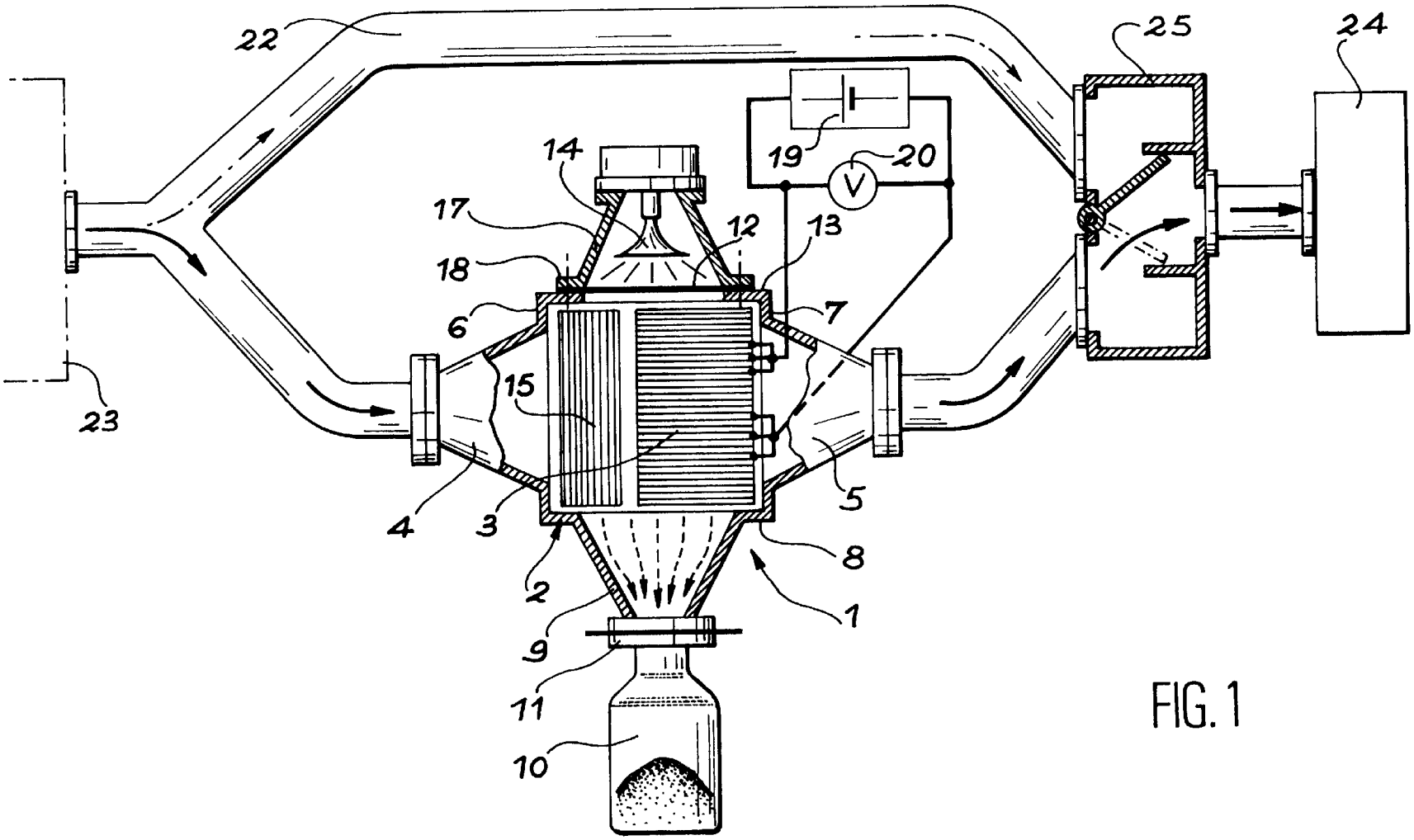
FIG. 1 is an overall view of the invention and a gas filtration installation.

The electrostatic filter 1 shown in FIG. 1 is approximately cube shaped and comprises an external enclosure 2 full of filter elements 3 which may be in the form of parallel plates oriented in the direction of circulation of a gas current entering through an inlet tube 4 and going out through an outlet tube 5 passing through the filter 1 between two lateral and opposite faces 6 and 7 of its enclosure 2. Filter elements 3 are preceded by an ionization cartridge 15 through which the gas also passes and in which transported particles acquire an electric charge. The bottom 8 of the enclosure 2 is perforated and terminates in a funnel which may be in contact with the opening of a bin 10 which collects dust accumulated on filter elements 3, and possibly also on elements of the ionization cartridge 15 when cleaning is started; if necessary, a connection system is placed between funnel 9 and bin 10, comprising a double door 11, frequently used in the nuclear industry and composed of two flanges each fixed to the opening of a receptacle, that can be connected together and separated whenever required and which are fitted with doors which couple with each other when the flanges are connected together, to open and close simultaneously. All these elements are already known, and therefore no additional description is necessary.

The essential element of the invention is provided at the top of filter 1 and consists of a membrane 12 that occupies part of the top face 13 of enclosure 2, behind which there is an acoustic wave generator 14. More specifically, the periphery of membrane 12 may be enclosed between two circular strips of sheet metal, in which the lower strip forms part of the top face 13 of the enclosure 2, and the upper strip is a hatch 17 attachment flange 18, which encloses the acoustic wave generator 14, on the top face 13.

It can be seen that starting the sound wave generator 14 will fill the contents of horn 17 with vibrations, and in particular will vibrate the air located under membrane 12 which consists of a thin sheet of plastic or metal material, or a material with similar acoustic properties which enable transmission of vibrations inside enclosure 2. The vibrations of the gaseous volume adjacent to filter elements 3 detach dust accumulated on these elements so that dust falls into bin 10. Obviously, the most appropriate sound waves for this purpose are chosen; it is preferable that they coincide with a coincident frequency of membrane 12, to enter a radiation mode; in real tests, complete cleaning has been observed by applying pulses of a few tenths of a second for a total duration of 10 seconds.

The coincident frequencies correspond to maximum transmission of the incident acoustic wave downstream from the membrane. The numbers of waves in air and in the plate or membrane coincide, and the maximum energy is transmitted.

The maximum radiation (therefore transmitted energy) through a membrane or plate does not necessarily occur at a resonant frequency; for optimum transmission, it is necessary for the frequency to exceed a critical frequency to obtain radiation.

In our tests, we successfully used a fairly slack 0.5 mm thick plastic (PVC) membrane: it can thus be imagined that this membrane shows a very low vibration. This observation proves that the phenomenon is transmission or transparency to acoustic waves, rather than resonance.

When we tried metal membranes, we obtained the best results with a 0.1 mm thick stainless steel membrane; we obtained good transmission of the acoustic wave and therefore successfully cleaned the filter. This test demonstrates that metal membranes, which have the advantage of being strong and easy to decontaminate, can be used.

The main frequencies emitted by the sound wave generator were multiples of 220 Hz, the first three and the fifth harmonics being the most energetic (about 220, 440, 660 and 1100 Hz).

It appears that the main frequencies transmitted through the 0.1 mm thick metal membrane were equal to or greater than 660 Hz; in particular we observed two peaks, centered at 660 and 1100 Hz respectively, when we measured the spectrum retransmitted by the membrane in the filter. This suggests that the critical frequency of the membrane is less than 660 Hz, but we did not verify this value analytically. Furthermore, we did not calculate its resonant frequencies since they were not useful for our tests.

The short cleaning period means that there is no need to interrupt the circulation of gases containing dust, even if it is preferred not to pass them through electrostatic filter 1; in this case a bypass 22 can be provided parallel to ducts 4 and 5, between an installation such as a combustion chamber in which the gases 23 originate, and a very high efficiency filter 24 beyond which gases, after the particles contained in them have been eliminated, are released into the atmosphere, or if they are dangerous, into chemical neutralization, molecule cracking installations, etc. depending on the case. A switching valve 25 is placed at the junction of the outlet pipe 5 and the bypass 22; normally, it closes the bypass 22 and allows the gases originating from the combustion chamber 23 to enter ducts 4 and 5 and electrostatic filter 1; but the inverse situation has been shown which occurs during cleaning, and in which gases containing dust pass through bypass 22, since the outlet duct 5 is closed.

Therefore, dedusting takes place entirely in the very high efficiency filter 24, which becomes dirty much more quickly, but for a short period. However, if it is considered that this additional dirt accumulation in the very high efficiency filter 24 is excessive, the installation shown in FIG. 2 may be preferred in which a second electrostatic filter 26 is placed in series with the first filter 1, between the combustion chamber 23 and the very high efficiency filter 24; a bypass 22 and a switching valve 25 are added to the electrostatic filter 1 as shown in FIG. 1, and the second electrostatic filter 26 is also fitted with a bypass 27 of a switching valve 28 using the same arrangement. During normal operation, the gas current passes in sequence through the 2 electrostatic filters 1 and 26, but when one of them is to be cleaned (for example filter 1 as shown in FIG. 3), its switching valve is controlled so that gases pass through the bypass around it, and dedusting is done entirely by the other electrostatic filter. Therefore, gases inlet into the very high efficiency filter 24 have always been partially purified.

Figure 2:
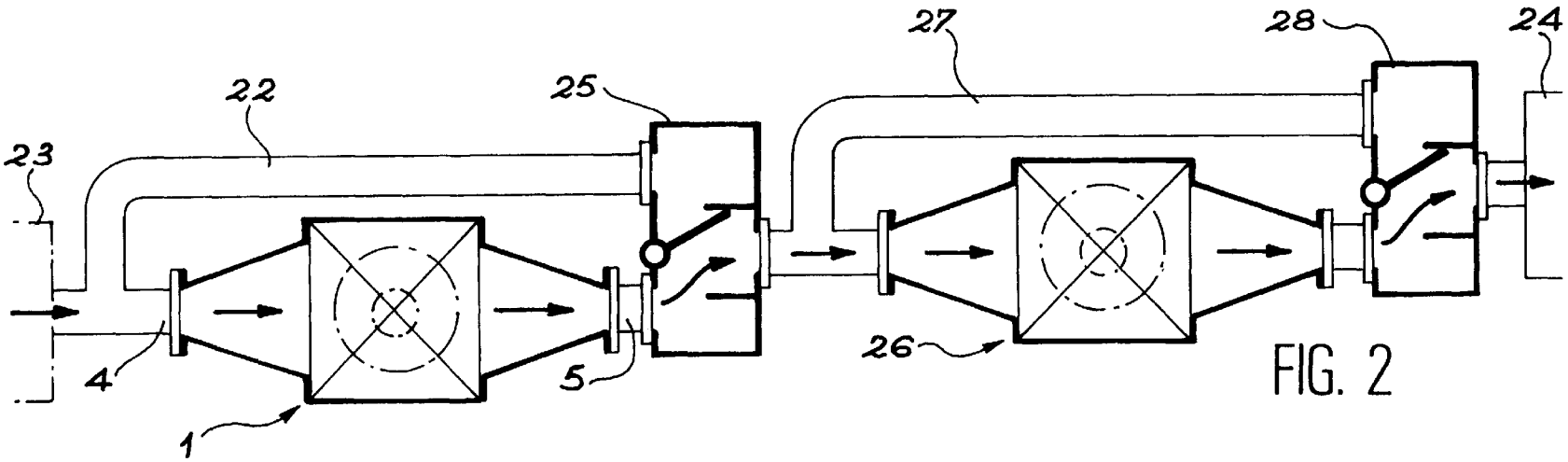
FIG. 2 is a view of another installation.
Figure 3:
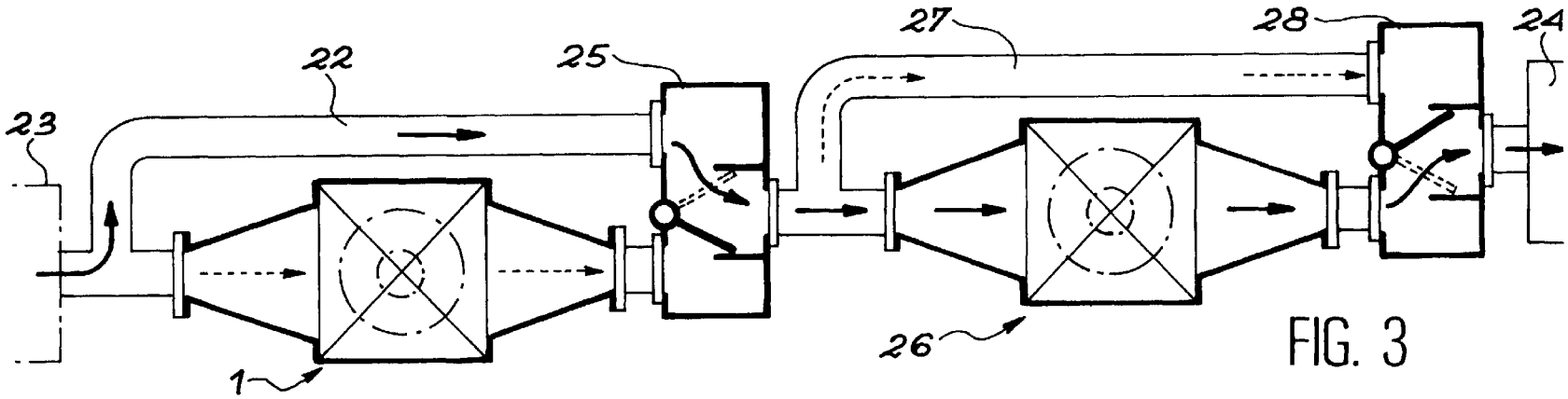
FIG. 3 is a view of this other installation in a second state.
Figure 4:
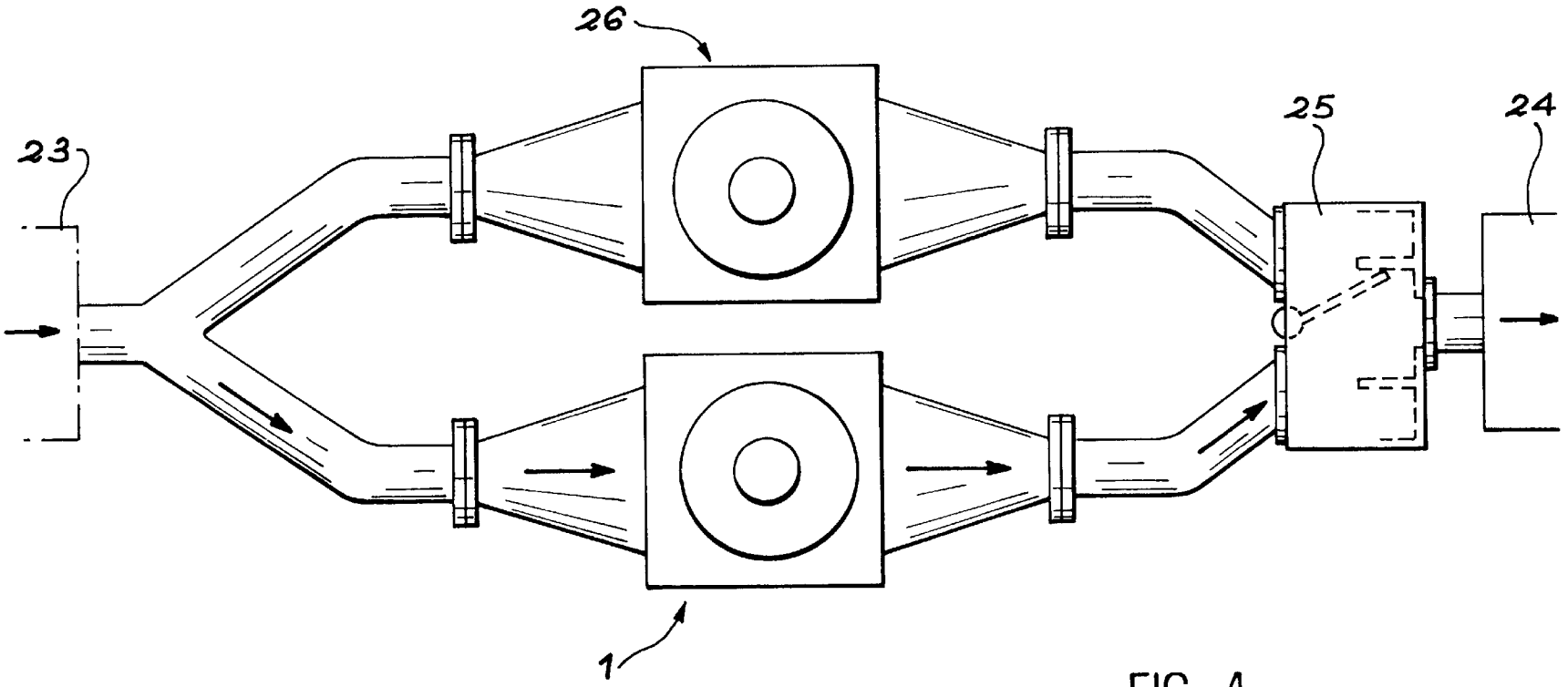
FIG. 4 is a view of a third possible installation.

Finally, an arrangement may be chosen in which the electrostatic filters 1 and 26 are arranged in parallel, as shown in FIG. 4; the second electrostatic filter 26 replaces the bypass 22 of FIG. 2; the switching valve 25 can be used to transfer the gas current into one of the electrostatic filters 26 at will, while the other remains at rest so that it can be cleaned if necessary; the switching valve 25 may be replaced by another valve, which enables the two branches of the circuit to be opened simultaneously during normal service.

It is sometimes difficult to determine the best time to clean, since dirt accumulated on an electrostatic filter does not cause blockage, such that gases continue to pass through normally even when the dedusting efficiency has dropped. According to the invention, this moment can be determined fairly precisely by means of the DC voltage generator 19 (see FIG. 1) on filter 1, which is connected between two groups of filter elements 3 to impose the potential differences on them that produce the electric field: the inventors observed that the voltage output by the voltage generator 19 drops as the filter elements 3 become dirty. Therefore they recommend that cleaning should take place when a voltage threshold is reached, determined by continuously measuring the voltage at the terminals of the generator 19 using a voltmeter 20 or equivalent instrument; the output voltage when the filter is clean under device operating conditions is 130 volts, and cleaning may be initiated if the output voltage drops below 115 volts. This criterion is suitable for use in an automatic cleaning process.

Finally note that the flexible membrane 12 enables the acoustic wave generator 14 to remain outside the filter, which has the effect of avoiding the air current supplying it from creating turbulence in filter 1, which could detach dust and allow it to pass into the very high efficiency filter 24.

What is claimed is:

1. Process for cleaning an electrostatic filter comprising an enclosure, a filter in the enclosure, a sound wave generator, and a flexible membrane of the enclosure separated from the filter and separating the sound wave generator from the filter, wherein the membrane has a frequency of coincidence at which the membrane transmits acoustic waves, and the generator produces sounds having a frequency almost coincident to said frequency of coincidence, characterized in that the sound wave generator is put into operation while the gas is kept in circulation through a bypass.

2. Cleaning process according to claim 1, characterized in that the gas is bypassed around the electrostatic filter while the said filter is being cleaned and is directed directly to a second filter (24) downstream from the electrostatic filter.

3. Cleaning process according to claim 1, characterized in that cleaning takes place as soon as a voltage maintained between the conducting elements (3) of filter (1) by a voltage generator (19) passes below a given threshold.

4. Cleaning process according to claim 1, characterized in that it is done without breaking the filter confinement.

5. An electrostatic filter assembly comprising an enclosure, a filter in the enclosure, a sound wave generator, and a flexible membrane of the enclosure separated from the filter and separating the sound wave generator from the filter, wherein the membrane has a frequency of coincidence at which the membrane transmits acoustic waves, and the generator produces sounds having a frequency almost coincident to said frequency of coincidence.

6. Filter according to claim 5, characterized in that the membrane (12) is located at the top (13) of the enclosure, a bin (10) is located under the filter (1) and there is a passageway into the filter through a collection duct (9), and gas inlet (4) and outlet (5) ducts for the gas to be filtered lead into the filter through two opposite parts (6, 7) of the enclosure (2).

7. Filters according to claim 5, characterized in that the sound waves consist of pulses lasting for at least a tenth of a second.

8. Filter according to claim 5, characterized in that the membrane is composed of a plastic or metal material.

* * * * *

UNITED STATES PATENT AND TRADEMARK OFFICE

CERTIFICATE OF CORRECTION

PATENT NO. : 5,900,043

DATED : May 4, 1999

INVENTOR(S) : Granjean et al.

It is certified that error appears in the above-identified patent and that said Letters Patent is hereby corrected as shown below:

On the Title Page, Section [56], References Cited, U.S. PATENT DOCUMENTS, 1st Reference, delete "55/92" and insert --55/292--.

Column 4, Line 39, after "output by the", insert --DC--.

Signed and Sealed this

Sixteenth Day of May, 2000

*Attest:*

Q. TODD DICKINSON

*Attesting Officer*

*Director of Patents and Trademarks*